United States Patent [19]

Fawcett

[11] Patent Number: 4,646,694

[45] Date of Patent: Mar. 3, 1987

[54] ROTARY ENGINE

[75] Inventor: Sherwood L. Fawcett, Columbus, Ohio

[73] Assignee: Battelle Development Corporation, Columbus, Ohio

[21] Appl. No.: 650,231

[22] Filed: Sep. 13, 1984

[51] Int. Cl.[4] ..... F02B 53/00

[52] U.S. Cl. ..... 123/245; 418/36; 418/125; 418/129; 418/144; 60/616

[58] Field of Search ..... 123/245; 417/568; 418/35, 36, 37, 38, 140, 144, 125, 129; 60/616

[56] References Cited

U.S. PATENT DOCUMENTS

| | | | |
|---|---|---|---|
| 154,003 | 8/1874 | Beal | 418/36 |
| 1,042,994 | 10/1912 | Wilson | 418/129 X |
| 1,302,233 | 4/1919 | Sheridan | 418/37 |
| 1,739,838 | 12/1929 | Johnson | 417/568 X |
| 3,398,643 | 8/1968 | Schudt | 418/36 |

*Primary Examiner*—Michael Koczo

*Attorney, Agent, or Firm*—Thomas H. Murray; Clifford A. Poff

[57] ABSTRACT

A rotary engine includes a housing having a cylindrical internal surface on which seals are supported to prevent the flow of gases from spaces between two rotating pistons on separate but concentrically-arranged shafts. Three sets of gearing control relative rotation of the pistons which move toward and away from each other to compress gases between the pistons. A drive shaft is connected by the first gear set to a first of the concentrically-arranged shafts. The drive shaft is also connected by a second gear set to the other of the concentrically-arranged shafts. The third gear set, comprised of non-circular gears, connects the drive shaft to an output shaft.

19 Claims, 18 Drawing Figures

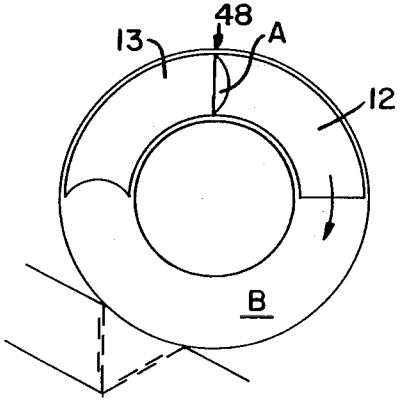
FIG. 8A
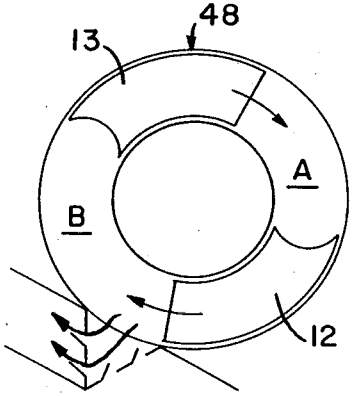
FIG. 8B
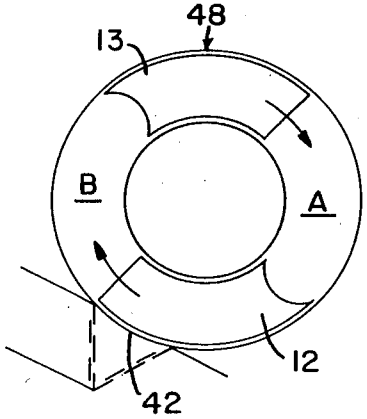
FIG. 8C
FIG. 8D
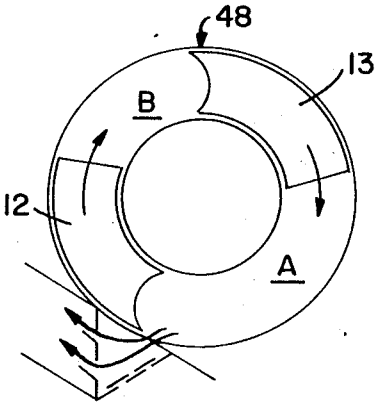
FIG. 8E
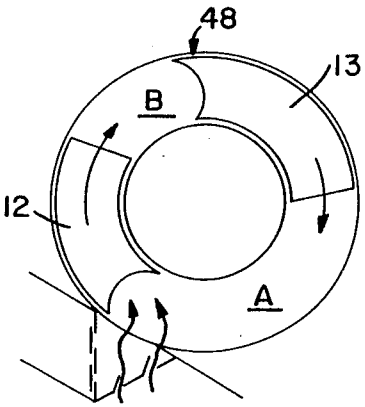
FIG. 8F
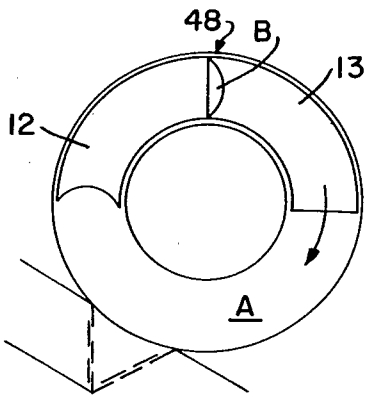
FIG. 8G

ROTARY ENGINE

This invention relates to a rotary engine, pump or compressor including a housing having seals to prevent a flow of gases from spaces between two rotating pistons on separate but concentrically-arranged shafts which are controlled by a plurality of sets of gearing to cause the pistons to move toward and away from each other for compression and expansion of gases in the spaces between the pistons.

The present-day conventional internal combustion engines combust a fuel-air mixture according to either the Otto cycle with spark ignition or the Diesel cycle with automatic ignition. The expansion chamber and compression chamber of these engines are essentially the same size and identical because of inherent geometry of the parts of a reciprocating piston engine and most rotary engines There is, however, a rotary engine configuration which requires only that the sum of the compression and expansion chamber volumes is a constant. This sum is equal to 360° less the arcuate lengths of the exaust and intake ports and one piston arcuate length, multiplied by the axial length of a piston. A rotary internal combustion engine of this type, unlike present-day combustion engines, has two or more pistons arranged to rotate in only one direction in a cylindrical cavity. An intake mixture of fuel and air is compressed in a space between the pistons by decreasing the relative rotation of the two pistons. One or more openings at the outer surface of a piston exposes the cavity between the pistons to spark ignition, or fuel ignition when the pistons are adjacent and in a correct position for ignition.

It is a well-known theoretical consideration that the efficiency of an ideal Brayton cycle is equal to the efficiency of an ideal Otto cycle and both cycles are independent of cycle temperature. On the other hand, the efficiency of an ideal Diesel cycle is less than the efficiency of the ideal Otto cycle given the same compression ratio and, furthermore, the efficiencies are load-dependent. The rotary internal combustion engine of the present invention allows the working gases to expand essentially to atmospheric pressure and uses an inlet pressure for the compression phase, always at atmospheric pressure. Thus, this engine configuration may be designed to produce an additional work output per cycle because of the expansion of the exhaust gases to atmospheric pressure.

The present invention is addressed to a rotary internal combustion engine having two or more pistons that can rotate about a common axis while separately joined to concentrically-arranged shaft members. Gases are expanded and compressed by relative rotation of the pistons toward and away from each other. Fuel may be mixed with oxygen-containing gases in a carburetor or supplied by injectors to the combustion spaces between the pistons. One piston is mounted on a hollow shaft segment which fits over a shaft segment that is mounted to the other piston. Bearings are used to support the shafts for independent rotation. In the past, the rotary internal combustion engine of this type was provided with seals supported on the outer periphery of the pistons to cooperate with the internal surface of the cylindrical cavity in an engine housing to prevent the flow of expanding and compressed gases between the pistons. Radial seals were also provided on the opposite ends of the pistons to maintain the expanding and compressed gases between the pistons. This arrangement of seals is inadequate because the seals are carried by the pistons across passageways that open out of the cylindrical surface of the internal cavity in the engine housing for conducting intake and exhaust gases for the engine. The effective operation and useful life of the seals are limited by a maximum surface velocity of the pistons relative to the cylinder wall. Also, the velocity of the pistons and the pressure on the seals undergo continuous changes throughout each complete cycle of the engine.

As a cycle begins, radial faces of two pistons are touching and moving, e.g., clockwise, at an instantaneous equal velocity. The fuel-air mixture compressed in the space between pistons is ignited by a spark (Otto cycle) or heat of compression (Diesel cycle). The forward piston is then accelerated to a position ahead of the trailing piston by a gear drive while the working gas is adiabatically expanded performing work on the gear train, until the forward piston unconvers the exhaust-/intake port. Exhaust gases move out of the engine through a check valve to the exaust duct. Meanwhile, fresh air-fuel mixture has been drawn in through the inlet duct/check valve into the working space behind the trailing piston, until the trailing piston covers the intake port. Thereafter, the intake gases between the pistons are compressed by relative advancement of the trailing piston toward the forward piston. Cavities in the radial faces of the pistons permit the pistons to touch. Thereupon, ignition occurs whereupon the combustion gases undergo adiabatic expansion to propel the forward piston until it uncovers the exhaust/intake port system as the cycle repeats. In this type of engine, as shown in U.S. Pat. No. 3,398,643, the two pistons are each connected by a non-circular gear set to a common drive output shaft. The net applied torque is the result of the pressure differential across the pistons minus the acceleration forces. The average pressure between the pistons is larger during the expansion phase than during the compression phase. It has been discovered that the moment of inertia of the pistons and associated drive gear sets is an important factor that can be utilized for minimizing fluctuations to the torque output and for reducing the forces operating on the pistons and drive trains. The rotary engine of the present invention provides torque on an output shaft that is substantially constant while rotating at a constant speed. While the features of the present invention have been described in terms of an internal combustion engine, it is clear that they are applicable to rotary pumps, gas compressors, gas expanders, external heat engines and heat pumps.

SUMMARY OF THE INVENTION

The present invention provides a rotary engine having two separate and concentrically-rotatable pistons which are coupled through separate gear sets by a third set of non-circular gearing so that during an expansion phase of gases between the pistons, the kinetic energy gained by the two pistons and their associated gear trains is equated to the energy of compression and energy required for the compression phase. A further characteristic achieved through the use of a third set of non-circular gearing according to the present invention is that the kinetic energy gained during the expansion phase between the two pistons is equated to the energy of compression and the load energy required in the expansion and compression phases. A still further benefit derived according to the present invention is that at any angle of the drive output shaft during an engine cycle, an energy balance is derived between a change in energy from dead-center condition of the kinetic energy of the piston system, the torque displacement of the gas system, and a constant load.

While not limited to the use of a third set of gearing which is non-circular, the present invention provides seal means situated in the engine housing to prevent fluid flow between the two pistons therein. The location of each seal means is chosen in relation to the arcuate size of the pistons so that preferably at least one seal always contacts each piston at all piston angles. The seal means are carried to extend from the engine housing into the cylindrical working chamber thereof for containing gases undergoing compression and expansion between the radial faces of two rotatable pistons while advancing and retreating relative to one another. The seal means also includes seals on end walls for the cylindrical working chamber to prevent leakage of the gaseous medium between the end walls of the pistons and the end walls of the working chamber.

These features and advantages of the present invention as well as others will be more fully understood when the following description is read in light of the accompanying drawings, in which:

FIGS. 8A–8G illustrate a schematic sequence of operation for the internal combustion engine according to the present invention;

Figure 1:
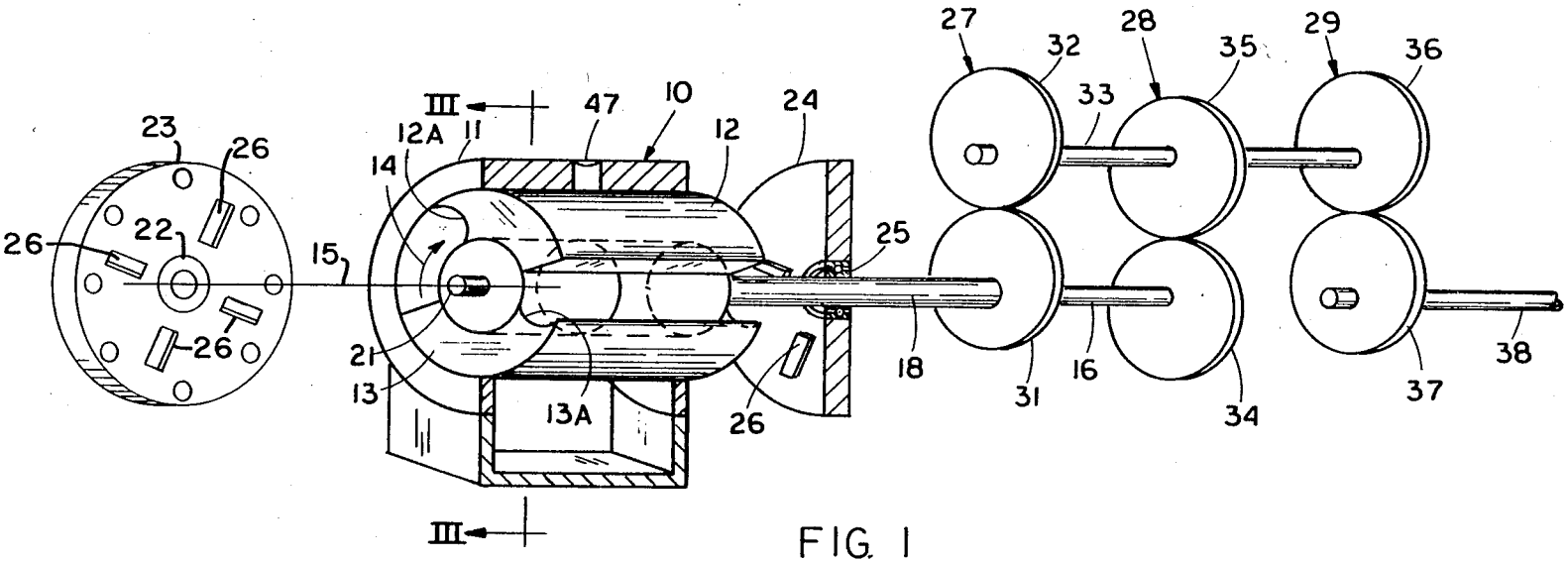
FIG. 1 is an isometric view, partly in section, of a rotary engine according to the present invention.
Figure 2:
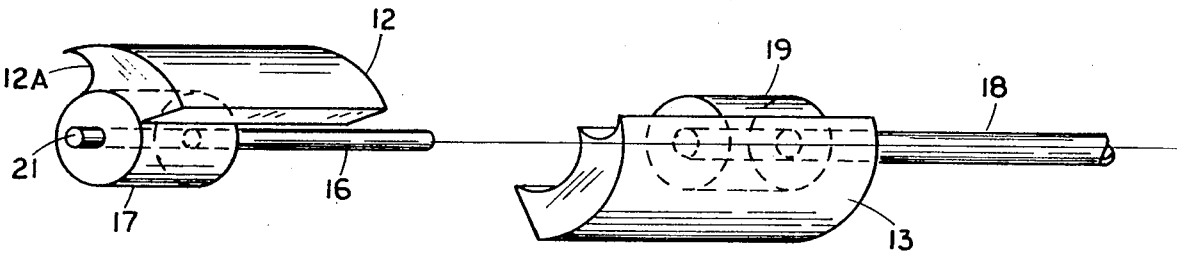
FIG. 2 is an isometric view of two pistons for the rotary engine shown in FIG. 1.

With reference now to the drawings and particularly to FIG. 1, an internal combustion engine 10 of the present invention includes an engine housing 11 having a cylindrical internal cavity wherein two arcuately-shaped pistons 12 and 13 can rotate in the same direction as indicated by arrow 14 about a common axis 15. As best shown in FIG. 2, axis 15 is coincident with a longitudinal axis of a shaft segment 16 connected by an arbor lug 17 to piston 12 and a tubular shaft segment 18 connected by an arbor lug 19 to piston 13. Shaft 16 extends through shaft 18. Referring again to FIG. 1, a shaft segment 21 extends from piston 12 for support by a bearing 22 carried by an end plate 23 that is, in turn, attached by bolts or otherwise secured to an end face of housing 11. A second end plate 24 carries a bearing 25 for rotatably supporting shaft 18. End plate 24 is attached by bolts or otherwise secured to the end face of housing 11 which is opposite end plate 23. The tubular configuration of housing 11 is formed with a smooth internal wall surface that supports seal means, illustrated and described in greater detail hereinafter, at spaced-apart locations for preventing the passage of gases from spaces between the end faces of the pistons. To prevent the flow of gases across the ends of the pistons, seals 26 are arranged at spaced-apart locations on the end plates 23 and 24 to engage with end surfaces at opposite ends of the pistons.

Movement of the pistons relative to one another while rotating about axis 15 is controlled by three sets of gearing 27, 28 and 29. Piston shaft 18 is connected to the first set of gearing 27 preferably non-circular and comprised of, for example, elliptical gears 31 and 32. Gear 31 is affixed to shaft 18 and meshes with gear 32 affixed to a drive shaft 33. The second set of gearing 28 preferably comprises non-circular gears, for example, elliptical gears 34 and 35. Gear 34 is affixed to shaft 18 and meshes with gear 35 which is affixed to shaft 33. The eccentricity of gear sets 27 and 28 is 180° out of phase. The third set of gearing 29 comprises, for example, elliptical gears 36 and 37. Gear 36 is affixed to shaft 33 and gear 37 is secured to an output shaft 38. The transmission formed by gear sets 27, 28 and 29 controls the relative movement of the pistons toward and away from each other and relative to a fixed position of housing 11, the position of intake and exhaust ports for gass and the position of compressed gases during ignition as established, for example, by a spark plug. The gear sets 27 and 28 can be comprised of elliptical, sinusoidal or other forms of non-circular gears to establish and control the positions of the pistons relative to each other and relative to the housing. The gear sets 27 and 28 do not produce a constant speed and/or constant output torque in shaft 33. These characteristics of power output of the engine are produced by the third set of non-circular gearing 29 which also provides that the moment of inertia of the piston system which is a design variable and a factor in determining the gear forces during the cycle can be utilized to store energy in one part of the cycle for use in another part of the cycle. The third set of non-circular gearing converts the resulting force motion outupt from the main shaftpiston system which will be a variable torque-variable speed output on drive shaft 33 into approximately or more substantially constant speed-constant torque output on the output shaft 38.

Figure 3:
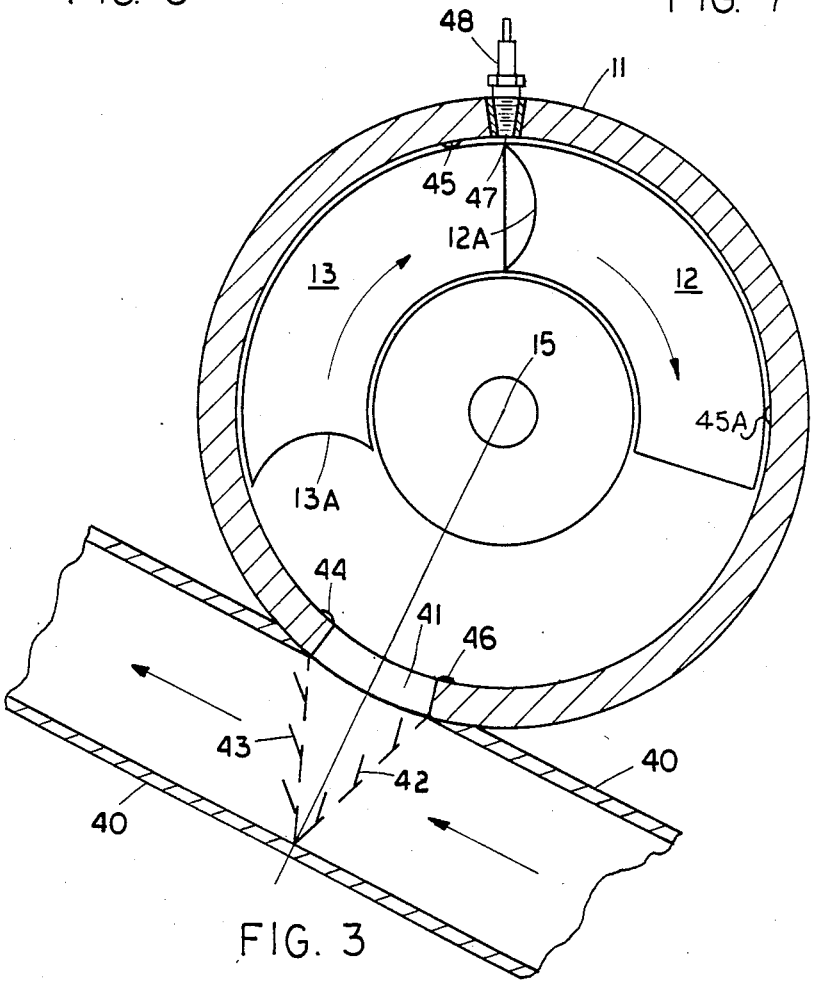
FIG. 3 is an enlarged sectional view taken along line III—III of FIG. 1.

In FIGS. 1 and 2, there is illustrated a preferred form of configuration for the pistons 12 and 13. Each piston comprises an arc segment of a cylinder with concave trailing end faces 12A and 13A, respectively, opposite radial faces 12B and 13B which are generally flat. A radial face of one piston is rotated into a position against or into a confronting position with the concave trailing end face of the other piston to form a chamber wherein a compressed fuel-air mixture is ignited. The concave configuration of the end face of each piston is chosen so that a desired compression ratio can be achieved using a charge of air or a fuel-air mixture at atmospheric pressure. The concave configuration at the trailing end faces of the pistons reduces the total force on the engine cylinder as the time of ignition of the compressed fuel-air mixture and reduces exposure of the cylinder wall to high-temperature gas as illustrated in FIG. 3. The leading edge of each piston, being generally planar, minimizes the mixing of fresh and exhaust gases as the pistons pass an intake/exhaust port 41 in the housing 11. The port 41 is connected by header pipes 40 provided with an intake gas control valve 42 and an exhaust control valve 43 such as reed valves to allow a fresh charge of air or an air-fuel mixture to enter unit cells between the pistons and exhausting burnt gases therefrom. A slight suction may be induced by the relative motion of the pistons forming the unit cells. The exhaust of burnt gases from the unit cells can be at atmospheric pressure or at pressure slightly above atmospheric. The location of the intake and exhaust ports can be chosen to optimize the amount of expansion in the expansion cycle as compared to the amount of compression. The site for the exhaust port is dependent upon the size of the exhaust port and the extent to which the gases are adiabatically expanded.

In FIG. 3, there is schematically illustrated a preferred arrangement of the intake/exhaust port 41. Also shown schematically in FIG. 3 are seal means to prevent the flow of gases from the unit cells between the pistons. The sites for the seal means are chosen so that a seal means is preferably always in contact with each piston while moving about axis 15. A seal 44 is supported in the cylinder wall of the housing at the downstream edge of exhaust port 41. A seal 45 is supported in the arcuate face of the housing at a point that is about midway between seal 44 and a seal 46, the latter being supported in the cylinder wall section of the housing at the leading edge of the intake port 41. A seal 45A is located about midway between seals 45 and 46.

The higher compression ratio which is generally required when the engine operates according to the Diesel cycle produces automatic ignition of oxygen-containing gases together with fuel which is supplied by injectors situated at site 47. In this event, the trailing end faces 12A and 13A of the pistons have cavities that are relatively small to produce the higher compression ratio by relative movement of the pistons. While these cavities preferably take the form of concave recesses, it is to be understood that the cavities may take the form of rectangularly-shaped recesses in the trailing faces of the pistons surrounded by a wall segment protruding from the piston end face. When the internal combustion engine operates according to the Otto cycle, there is located at site 47 an ignition device 48 such as a spark plug.

Figure 4:
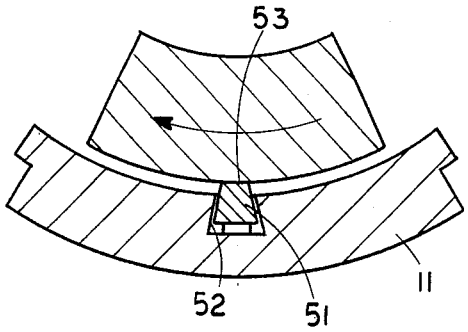
FIG. 4 is an enlarged sectional view illustrating a first embodiment of the seal means according to the present invention.

Embodiments of the seal means are shown in FIGS. 4–7. In FIG. 4, the seal means includes a seal element 51 having a keystone shape in cross section and situated in a similarly-shaped slot 52 extending along the length of the cylindrical surface of the housing 11. The slot 52 has opposite side walls that extend in a manner of convergence at a point spaced toward axis 15. A bottom wall of the slot supports an elastic element used to urge the seal element 51 so that the tapering side walls of the keystone shape are supported by the side walls of the slot while an arcuate end surface 53 on a protruding portion of the seal which extends from the slot establishes a gas-sealing relationship with the outer peripheral surface of the rotating pistons.

Figure 5:
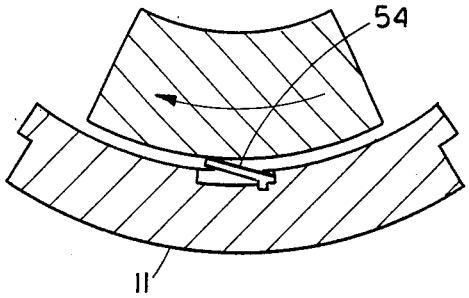
FIG. 5 is an enlarged partial view similar to FIG. 4 but illustrating a second embodiment of the seal means.

In FIG. 5, an embodiment of the seal means includes an elastic seal strip 54 secured along one edge in a longitudinal recess formed in the inner circumference of the housing 11. The seal strip extends from the recess so that a resilient edge portion can form a gas-sealing relationship with the outer peripheral surfaces of the moving pistons.

Figure 6:
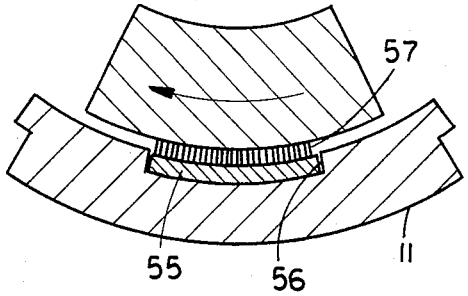
FIG. 6 is an enlarged partial view similar to FIG. 4 but illustrating a third embodiment of the seal means.

In FIG. 6, an embodiment of the seal means takes the form of a labyrinth seal which includes a base 55 supported in an arcuate slot 56 extending along the length of the housing 11. The base supports parallel and radially-extending strips 57 at closely, spaced-apart locations. The strips extend close to the moving outer peripheral surfaces of the pistons to prevent te flow of fluid past the seal.

Figure 7:
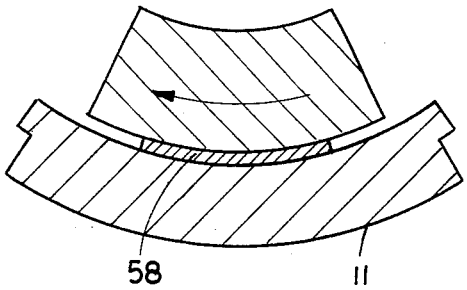
FIG. 7 is an enlarged partial view similar to FIG. 5 but illustrating a fourth embodiment of the seal means.

In FIG. 7, there is illustrated an embodiment of the seal formed by adhering porous, wear-resistant material 58 onto a short arcuate segment of the inner circumferential surface of the housing 11. Material 58 takes the form of a thin lining which forms a seal between the rotating pistons. The porous material of the lining is abraded, in situ, to remove excessively protruding amounts of seal material by rotation of the pistons or a suitable machine element. The number of seals supported by the housing to prevent flow past the pistons is determined by the arcuate length of the pistons. Preferably, the pistons have an arcuate length in the range of 90° to 120°. When gear set 29 comprises elliptical gears, an optimum arcuate piston length is about 106°. The large arcuate size of the pistons permits positioning of the seals on the internal cylindrical surface of the housing and on the end plates rather than on the moving pistons. A particular embodiment of the seal can be chosen from the various seals shown in FIGS. 4–7 based on particular conditions of pressure, temperatures and surface velocities of the pistons according to operating conditions. Moreover, because the seals are placed on the stationary cylindrical surface of the engine housing, the seals are never exposed to extreme conditions as exist when the seals are supported on the moving pistons. Seals 26, shown in FIG. 1, can be constructed as shown in FIGS. 4–7.

In FIGS. 8A–8G, there is schematically illustrated the sequence of operational phases by the internal combustion engine of the present invention when operating according to the Otto cycle. In FIG. 8A, the ignitor, such as a spark plug 48, is energized to ignite a compressed fuel-air mixture in unit cell A between pistons 12 and 13. At the same time, expanded burnt gases are exhausted from unit cell B. Gear sets 27–29 allow the gases expanded in unit cell A to propel the piston 12 forwardly at a greater speed than the speed at which piston 13 is advanced. Cell A expands during the period shown by FIGS. 8A–8D. Any pressure in cell B is exhausted to atmospheric pressure and a fresh charge of fuel and air is charged into cell B by the time piston 12 closes off port 42 as shown in FIG. 8C. Expansion of gases in unit cell A continues until piston 12 moves across the exhaust port as shown in FIG. 8D. The exhaust of burnt gases from unit cell A as shown in FIG. 8E takes place when the trailing edge of the piston moves to expose unit cell A to the port 42, thus reducing the pressure of burnt gases to atmospheric pressure. Thereafter, a fresh charge of fuel and air is drawn into unit cell A while the piston 12 moves towards the trailing edge of piston 13. The compressed gases in unit cell B are then ignited by operation of the spark plug.

Figure 9:
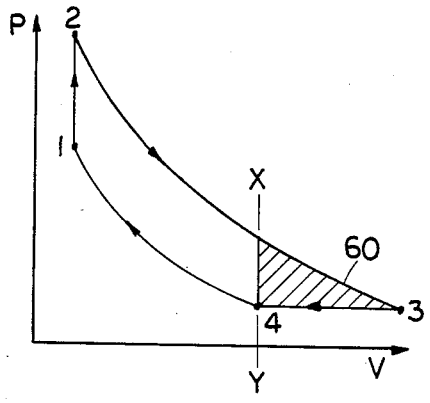
FIG. 9 is a graph illustrating pressure versus combustion space volume for a combustion engine of the present invention operated according to an Otto cycle.

The graph of FIG. 9 illustrates a volume-pressure relationship of unit cells A and B in which the shaded area 60 represents the net additional energy gain due to expansion of gases to atmospheric pressure as compared to a conventional Otto cycle in which expansion ends at some positive gas pressure above atmospheric pressure as indicated by line X-Y. Ignition of the compressed fuel-air mixture in a unit cell according to the sequence described previously in regard to FIG. 8A, bring about a sharp increase in pressure in a unit cell at constant volume as illustrated from point 1 to point 2. Expansion of the gases in the unit cell by movement of the pistons reduces the pressure while increasing the volume in the unit cell is depicted in the graph between points 2 and 3 which correspond to the part of the cycle illustrated in FIG. 8B. Between points 3 and 4, the unit cell is charged with air or fuel and air at constant pressure, preferably at about atmospheric pressure. The newly-charged air or fuel-air mixture is then compressed between the pistons as depicted between points 4 and 1.

The use of the three sets of gearing 27–29 provides the features and advantages of a transmission function and a drive-train function. It is neessary to consider each of the above-described operational phases shown in FIGS. 8A–8G and the pressure-volume relationship as described and shown in FIG. 9 in terms of the forces of the pistons 12 and 13. Let it be assumed that positive forces act in the direction of motion of the pistons and let it be further assumed that piston 12 is the fastmoving piston in front of a working or unit cell. Between points 1 and 2 in FIG. 9, energy is not transformed. Between points 2 and 3, the expansion of gases produces a positive gas pressure on piston 12 and a negative gas pressure on piston 13. There is negative inertia in the piston system with respect to piston 12 and positive inertia in the piston system with respect to piston 13. Pistons 12 and 13 impose a positive force load on the drive shaft 33. Between points 3 and 4, the energy transformation is the same as between points 2 and 3. Between points 4 and 1, there is a negative gas pressure on piston 12 due to the compression of gases and a positive gas pressure on piston 13 due to the expansion of gases. Piston 12 provides a positive inertia in the piston system while piston 13 exerts a negative inertia on the piston system. Pistons 12 and 13 both exert a negative load on the drive shaft 33.

From basic physics considerations, in a steady-state motion, the sum of the forces on each piston integrated over the cycle is equal to zero. Since the gas pressure on the pistons varies considerably over the cycle, it is clear that the mechanical transmission formed by gear sets 27–29 between the piston system and the load, converts the net variable torque on the pistons to a constant speed-constant torque load. In a conventional reciprocating piston engine this is accomplished by providing a flywheel to store energy in phases of the cycle and supply energy in other phases of the cycle. Thus, a flywheel is a practical solution that works as a compromise at the expense of high-variable forces on the reciprocating pistons.

The transmission function of the gear sets of the present invention provides that the gear sets control the positions of the pistons relative to each other; relative to the housing and firing mechanism throughout the cycle as well as transmit the net power output through the drive shaft with approximate constant speed and constant torque output. The moment of inertia is a factor in determining the energy forces during the cycle which are utilized to store energy in one part of the cycle for use in another part of the cycle. The set of non-circular gearing converts the resulting force motion output from the main shaft 33 and piston system which is a variable torque-variable speed output into a substantially constant speed-constant torque output on the drive shaft 38 to the load. It will be understood by those skilled in the art that gear sets 27 and 28 can be coupled with a differential or a cascade of gears when small arcuately-sized pistons or other piston design features are desired. Similarly, the third gear set 29 can be used in conjunction with a differential or a cascade of non-circular gears, if necessary, to meet unusual pressure or displacement conditions of the working fluid medium.

Figure 10:
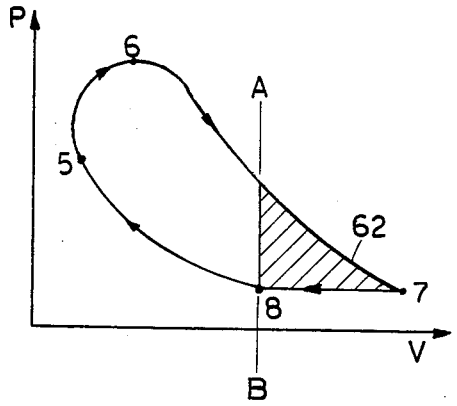
FIG. 10 is a graph illustrating pressure versus combustion space volume for an internal combustion engine of the present invention operated according to a Diesel cycle.

As described previously, the trailing faces of pistons 12 and 13 are preferably concave to provide a working space for compressing gases of a unit cell. However, when operating according to the Diesel cycle, the trailing face of each piston should be provided with a smaller cavity to increase the compression ratio as required to effect automatic ignition. The foregoing description of the Otto cycle in regard to FIGS. 8A–8E applies as will be apparent to those skilled in the art to operation of the rotary engine according to the Diesel cycle. It is to be understood, of course, that a fuel injector is placed at site 47 and the use of a spark plug is eliminated. The graph of FIG. 10 illustrates a volume-pressure relationship of a unit cell of the rotary engine according to the Diesel cycle. The shaded area 62 corresponds to area 60 and represents the net additional energy gain due to expansion of gases to atmospheric pressure as compared to a conventional Diesel cycle. In the conventional Diesel cycle, expansion ends at some positive pressure above atmospheric pressure as indicated by line A-B. Between points 5 and 6, air is compressed in a unit cell together with injected fuel for atuomatic ignition. Between points 6 and 7, the gases in the unit cell undergo adiabatic expansion to substantially atmospheric pressure as the volume in the unit cell increases. Between points 7 and 8, the unit cell is charged with air at a constant pressure, preferably at about atmospheric pressure. The newly-charged air is then compressed between the pistons as depicted between points 8 and 5. More specifically, the arrangement of ports and the sequence of events in the cycle could be changed to configure the engine as an external heat engine, a pump or compressor, a heat pump, or a gas expander. In all of these embodiments, the invention described herein utilizing seals in the cylindical housing and end pieces, pistons with arcuate length between 90° and 120°, and three sets of transmission gears would be applicable.

Figure 11:
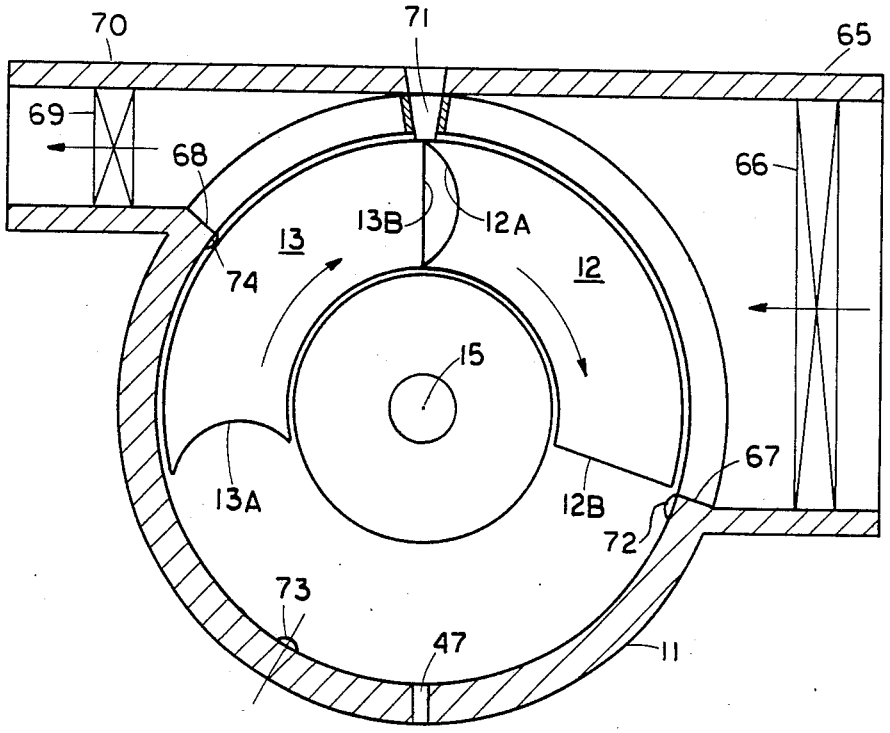
FIG. 11 is a sectional view, similar to FIG. 3, illustrating a compressor embodiment of the present invention.

As described hereinbefore, the rotary engine of the present invention may be embodied for use as a compressor or expansion system. FIG. 11 illustrates an embodiment of the present invention forming a compressor wherein parts have been identified by the same reference numerals as described hereinbefore and illustrated in FIG. 3. The construction of pistons 12 and 13 and their controlled rotation by three sets of non-circular gearing as previously described provides that the pistons rotate in the same direction at a variable speed such that the arc space between the pistons changes from zero to $2\pi-2\phi_p$ where $\phi_p$ is the piston arcuate length. The non-circular gearing can be chosen such that, at design speed, the output torque and speed of the output/input are constant, or closely approximated for a particular gas pressure/volume relation. The working gas enters an intake header pipe 65 and passes through a control valve 66, such as a reed valve for passage through an intake port 67 into a unit cell between pistons 13 and 13. Gas is exhausted from a unit cell through an exhaust port 68 for delivery through a gas control valve 69, e.g., a reed valve, in a header pipe 70. The arcuate size of the ports 67 and 68 and their location in the housing are chosen to match the pressure/volume/-temperature characteristics of the gaseous media. The ports are also designed to maximize the flow characteristics of the gas which enters and leaves the compressor. The arcuate length of the pistons is also determinative of the sizes for the intake and exhaust port openings and to minimize accleration forces. The arcuate size of the compressor pistons is preferably about 106° when elliptical gears comprise the gear sets. The arcuate length of intake port 67 is substantially larger, e.g., two times, than the arcuate length of the exhaust port 68.

Shown schematically in FIG. 11 are seal means to prevent the flow of gases from unit cells between the pistons. The sites for seal means are chosen so that one seal means is perferably always in contact with each piston while moving about axis 15. There are four seal means shown in FIG. 11 which comprise a seal 71 supported in a wall segment of housing 11 between the intake and exhaust ports 67 and 68. The arcuate length of this wall segment is sufficient essentially only to support seal 71 to extend generally parallel to the axis 15. A seal 72 is supported in the cylinder wall of the housing at the downstream edge of intake port 67. A seal 73 is supported in the arcuate face of the housing at a point that is about midway between seal 72 and a seal 74, the latter being supported in the cylinder wall section of the housing at the leading edge of the exhaust port 68. It is to be understood, of course, that the trailing end faces 12A and 13A of the pistons may be provided with cavities which are designed to produce the desired compression ratio through relative movement of the pistons. While these cavities may take the form of concave recesses, they may be constructed in the manner described hereinbefore. The seal means 71–74 are constructed according to any one of the embodiments described and shown in FIGS. 4–7. Seal means on the end plates 23 and 24 of the housing 11 as described hereinbefore and shown in FIG. 1 are provided to prevent fluid flow from a unit cell between the pistons.

Figure 12:
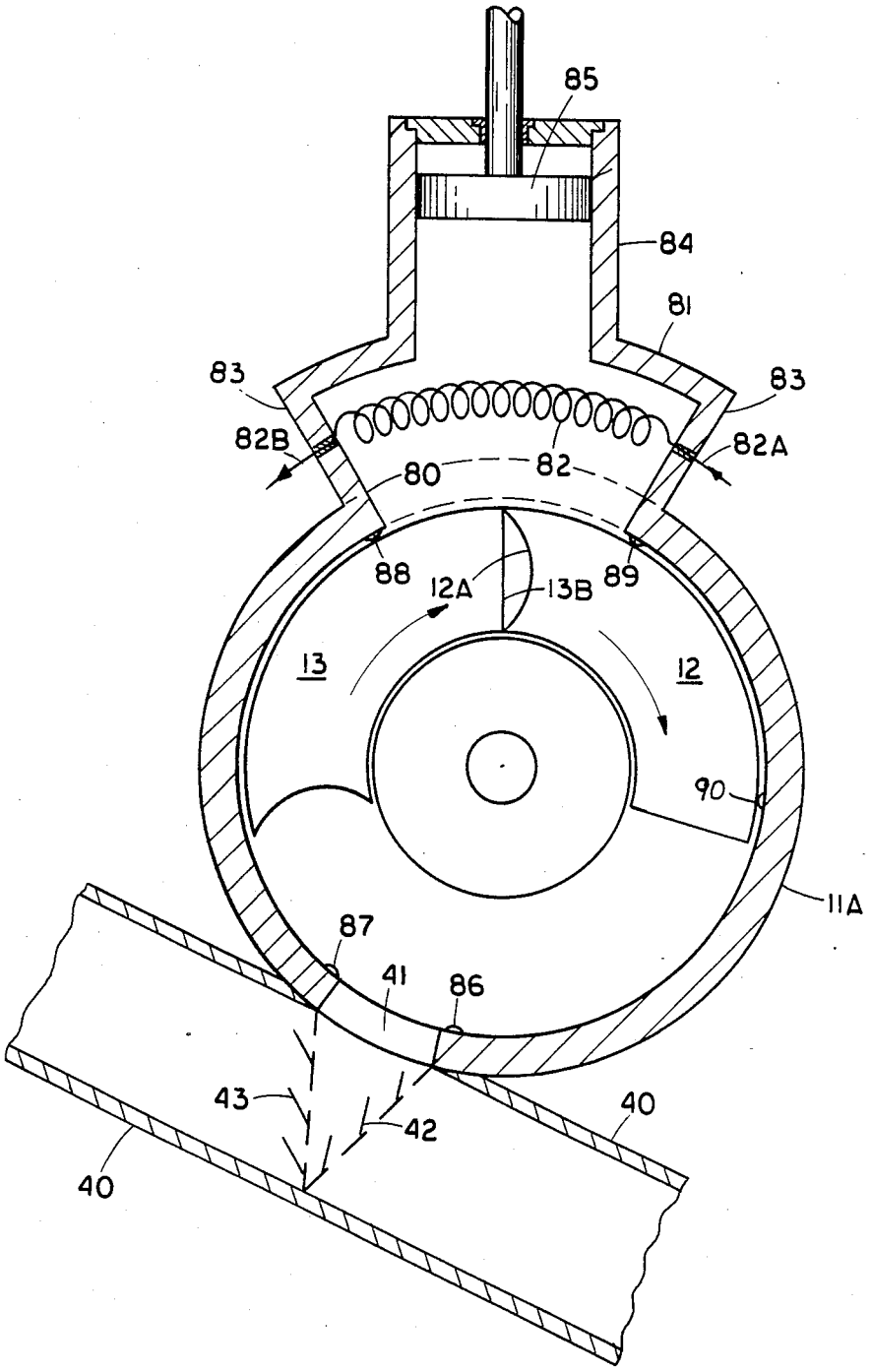
FIG. 12 is a sectional view, similar to FIG. 3, illustrating an external heat engine embodiment of the present invention.

The rotary engine of the present invention may be embodied for operation as an exernal heat engine as schematically illustrated in FIG. 12 wherein parts which have been previously described are identified by the same reference numerals. The pistons 12 and 13 rotate in the same direction and move toward and away from each other under control provided by the three sets of gearing as previously described. The intake/exhaust port 41 is formed in a cylindrical housing 11A which is provided with end plates 23 and 24 having seal means thereon as previously described. Inlet gas is fed by the header pipe 40 through valve 42 and exhaust gas is delivered by port 41 through the valve 43 to header pipe 40. The intake/exhaust port is situated at a site in the housing wall 11A which is approximately diametrically opposite a position where the pistons are brought into contact with one another or a position of closest approach. The valves 42 and 43 provide that any suction on the system is eliminated by exhausting or intake of atmospheric air.

As illustrated in FIG. 12, end faces 12A and 13B of pistons 12 and 13, respectively, contact each other at a site of an enlarged arcuate opening 80 which is enclosed by a manifold 81 attached to the housing 11A. A heat exchanger 82 extends along the arcuate length of the manifold 81 between end walls 83. The heat exchanger, which can be a spiral tube, is coupled to a source of high-temperature fluid at end portion 82A and a return line at end portion 82B. The high-temperature fluid can be gases of combustion, e.g., engine exhaust gases. The heat exchanger is heated to a higher temperature than would be expected from simple adiabatic heating. Thus, air is alternately pushed into the heat exchanger after a compression phase of the pistons and air is expanded from the heat exchanger in an expansion phase whereby the cycle is substantially the same as described and shown in FIGS. 8A–8E. An opening in the manifold 81 is connected to a chamber wall 84 which extends about the periphery of piston 85. The piston is moved along the chamber wall to vary the manifold volume containing the heat exchanger to permit optimization of the pressure ratio of the engine based on ambient temperature and heat exchanger fluid temperature.

The external heat engine shown in FIG. 12 operates by exhausting air from a previous cycle through the reed valve 43 as the piston 12 moves the exhaust gases-/air to a pressure above the pressure of the exhaust gases in manifold 40. Intake air is drawn through the manifold and reed valve 42 when piston 12 passes the exhaust/intake port, thereby drawing a suction on the reed valves. The position of the heat exchanger port formed by opening 80 and the position of the intake/exhaust port can be chosen to optimize operation of the engine as an external heat engine. Seals on the internal surface of housing 11A prevent fluid flow from unit cells between the pistons. Seals 86 and 87 are situated at the leading and trailing edges, respectively, of port 41 and seals 88 and 89 are situated at the leading and trailing edges of opening 80, respectively. A seal 90 may be located about midway between seals 86 and 89. Each piston is preferably always in contact with one of the seals 86–90 while rotating in the housing. The seals 86–90 may be embodied as shown and described in FIGS. 4–7.

Although the invention has been shown in connection with certain specific embodiments, it will be readily apparent to those skilled in the art that various changes in form and arrangement of parts may be made to suit requirements without departing from the spirit and scope of the invention.

What is claimed is:

1. In an internal combustion engine, external heat engine, heat pump, gaseous expander, pump or gas compressor, the combination including means forming a cylindrical working chamber having intake and exhaust port means for gases, two pistons having an arcuate length within the range of 90° to 120° of the cylindrical portion of said working chamber to move toward and away from each other for compression and expansion of gases by rotation on separate concentrically-arranged shafts, seal means carried by the walls of said cylindrical working chamber at each of spaced apart loctions to continuously form a gas sealing relation with both of said pistons while the pistons rotate toward and away from each other in said cylindrical working chamber, seal members for each of opposite ends of the pistons, said seal means and seal members substantially preventing passage of gases from unit cells between said pistons while rotating on said concentrically-arranged shafts, an output shaft, and means for drivingly connecting said output shaft to said pistons.

2. The internal combustion engine, external heat engine, heat pump, gaseous expander, pump or gas compressor according to claim 1 wherein said seal means includes closely, spaced-apart strips extending in a generally parallel direction to the rotation of said pistons along the length of said working chamber and radially in the end pieces at the same arc location forming labyrinth seals supported by a wall of said working chamber.

3. The internal combustion engine, external heat engine, heat pump, gaseous expander, pump or gas compressor according to claim 1 wherein said seal means includes seal strips each supported by a recess in said working chamber, said recess being elongated in a direction generally parallel to a rotational axis of said pistons, and resilient means for urging said seal strips in a direction toward said pistons.

4. The internal combustion engine, external heat engine, heat pump, gaseous expander, pump or gas compressor according to claim 1 wherein said seal means includes a strip having a resilient edge portion supported in a recess in said working chamber for extending in the direction of rotation by said pistons therein.

5. The internal combustion engine, external heat engine, heat pump, gaseous expander, pump or gas compressor according to claim 1 wherein said seal means includes an adhered layer of porous material extending along a wall surface of said working chamber in a direction generally parallel to the rotation of said pistons and radially at the end housing.

6. The internal combustion engine, external heat engine, heat pump, gaseous expander, pump or gas compressor according to claim 1 wherein said seal means includes a plurality of seals arranged in a spaced-apart relationship and extending along said working chamber on the wall thereof at locations such that each piston contacts at least one seal at all times during rotation of the pistons in said working chamber.

7. The internal combustion engine, external heat engine, heat pump, gaseous expander, pump or gas compressor according to claim 6 wherein said intake and exhaust port means is defined by an intake port and an exhaust port separated by a wall section of said working chamber, a first of said seals extends along a wall section of said working chamber between said intake and exhaust ports, a second of said seals extends along a wall section of said working chamber in the close vicinity of said intake port, a third of said seals extends along a wall section of said working chamber in the close vicinity of said exhaust port, and a fourth of said seals extends along a wall section of said working chamber in a generally parallel and equal distance between the second and third seals with radial seals in the same arcuate position at the end housings.

8. The internal combustion engine, external heat engine, heat pump, gaseous expander, pump or gas compressor according to claim 6 wherein a first and second of said seals extend along a wall section of said working chamber along opposite sides of said intake and exhaust port means, and a third of said seals extends along a wall section of said working chamber generally diametrically opposite said intake and exhaust port means.

9. The internal combustion engine, external heat engine, heat pump, gaseous expander, pump or gas compressor according to claim 6 further including heat exchanger means for supplying heated gases to unit cells between pistons in said cylindrical working chamber.

10. The internal combustion engine, external heat engine, heat pump, gaseous expander, pump or gas compressor according to claim 9 wherein said heat exchanger means includes a manifold connected by a port in a wall of said cylindrical working chamber for the entrance and exit of working gases.

11. The internal combustion engine, external heat engine, heat pump, gaseous expander, pump or gas compressor according to claim 10 further including means for varying the volume of heat exchange working space defined by said heat exchanger means to optimize thermodynamic efficiency.

12. The internal combustion engine, external heat engine, heat pump, gaseous expander, pump or gas compressor according to claim 11 wherein said means for varying volume includes a movable piston in a cylinder communicating with said heat exchanger means.

13. The internal combustion engine, external heat engine, heat pump, gaseous expander, pump or gas compressor according to claim 12 wherein said heat exchanger means includes a conduit for conducting a highly-heated medium.

14. The internal combustion engine, external heat engine, heat pump, gaseous expander, pump or gas compressor according to claim 9 wherein said intake and exhaust port means is arcuately spaced from said heat exchanger means for permitting expansion of gases to substantially atmospheric pressure in unit cells between said pistons.

15. The internal combustion engine, external heat engine, heat pump, gaseous expander, pump or gas compressor according to claim 9 further comprising reed valves for controlling the flow of gases in said intake and exhaust port means.

16. The internal combustion engine, external heat engine, heat pump, gaseous expander, pump or gas compressor according to claim 1 further comprising reed valves for controlling the flow of gases in said intake and exhaust port means.

17. The internal combustion engine, external heat engine, heat pump, gaseous expander, pump or gas compressor according to claim 7 wherein said intake and exhaust ports for said working chamber are separated by a wall section having an arcuate length sufficient to support said first seal.

18. The internal combustion engine, external heat engine, heat pump, gaseous expander, pump or gas compressor according to claim 17 wherein said intake port has an arcuate length along a wall of said working chamber corresponding approximately to the arcuate length of one of said pistons.

19. The internal combustion engine, external heat engine, heat pump, gaseous expander, pump or gas compressor according to claim 18 wherein the arcuate length of each of said pistons is about 106°, and said internal combustion engine further includes means for igniting a mixture of compressed fuel and air in a unit cell between said pistons.

* * * * *